US006334576B1

(12) United States Patent
Cho

(10) Patent No.: US 6,334,576 B1
(45) Date of Patent: Jan. 1, 2002

(54) FUEL INJECTOR HAVING A BALL SEAT WITH MULTIPLE TIP GEOMETRY

(75) Inventor: Yong Duk Cho, Yorktown, VA (US)

(73) Assignee: Siemens Automotive Corporation, Auburn Hills, MI (US)

( * ) Notice: Subject to any disclaimer, the term of this patent is extended or adjusted under 35 U.S.C. 154(b) by 0 days.

(21) Appl. No.: 09/606,523

(22) Filed: Jun. 30, 2000

(51) Int. Cl.[7] ..... F02D 1/06; F02M 61/00

(52) U.S. Cl. ..... 239/5; 239/533.12; 239/585.1; 239/600; 239/900

(58) Field of Search ..... 239/585.1, 585.4, 239/585.5, 584, 533.12, 900, 600, 5; 29/890.142, 890.143, 888.44, 888.45

(56) References Cited

U.S. PATENT DOCUMENTS 4,454,990 A 6/1984 Lewis
4,494,701 A 1/1985 Hensley et al.
4,662,567 A 5/1987 Knapp
4,759,331 A 7/1988 Sausner
4,934,605 A 6/1990 Hans et al.
5,004,162 A 4/1991 Stettner et al.
5,024,385 A 6/1991 Olson
5,273,215 A 12/1993 Hans et al.
5,476,226 A 12/1995 Tomiita et al. .....

*Primary Examiner*—Steven J. Ganey

(57) ABSTRACT

The present invention provides a fuel injector having a fuel inlet, a fuel outlet, and a fuel passageway extending from the fuel inlet to the fuel outlet along a longitudinal axis. The fuel injector includes an armature disposed within the body, a cylindrical needle operatively connected to the armature, the needle having a support portion and a flow control portion, and a seat disposed at the fuel outlet. The fuel injector also includes a ball operatively connected to the support portion of the needle such that the flow control portion protrudes from the ball toward the seat.

18 Claims, 2 Drawing Sheets

FUEL INJECTOR HAVING A BALL SEAT WITH MULTIPLE TIP GEOMETRY

FIELD OF INVENTION

This invention relates to fuel injectors in general, and more particularly to a fuel injector assembly which includes a modified needle tip having a ball seat with multiple tip geometry for fuel mixing for maximizing fuel combustion.

BACKGROUND OF THE INVENTION

In the case of internal combustion engines having fuel injection systems, fuel injectors are conventionally used to provide a precise amount of fuel needed for combustion. The fuel injector is required to deliver the precise amount of fuel per injection pulse and maintain this accuracy over the life of the injector. In order to optimize the combustion of fuel, certain strategies are required in the design of fuel injectors. These strategies are keyed to the delivery of fuel into the intake manifold of the internal combustion engine in precise amounts and flow patterns. Conventional fuel injector designs have failed to optimize the combustion of fuel injected into the intake manifold of an internal combustion engine.

SUMMARY OF THE INVENTION

The present invention overcomes the disadvantages of conventional fuel injectors and provides a fuel injector which incorporates a needle with a novel ball seat design and multiple tip geometries, which can provide various flow patterns and improved spray atomization for fuel for improved combustion.

The present invention provides a fuel injector having a fuel inlet, a fuel outlet, and a fuel passageway extending from the fuel inlet to the fuel outlet along a longitudinal axis. The fuel injector includes a body, a cylindrical needle slidingly disposed within the body, the needle having a support portion and a flow control portion, and a seat disposed at the fuel outlet. The fuel injector also includes a ball operatively connected to the support portion of the needle such that the flow control portion protrudes from the ball toward the seat.

The present invention also provides a method of controlling a fuel spray pattern in a fuel injector, the fuel injector having a body, a cylindrical needle slidingly disposed within the body, the needle having a support portion and a flow control portion, and a seat disposed at the fuel outlet. The method includes the steps of providing a ball operatively connected to the support portion of the needle such that the flow control portion protrudes from the ball toward the seat and providing fuel to the fuel injector.

BRIEF DESCRIPTION OF THE DRAWINGS

The accompanying drawings, which are incorporated herein and constitute part of this specification, illustrate presently preferred embodiments of the invention, and, together with the general description given above and the detailed description given below, serve to explain features of the invention.

DETAILED DESCRIPTION OF THE PREFERRED EMBODIMENT

Figure 1:
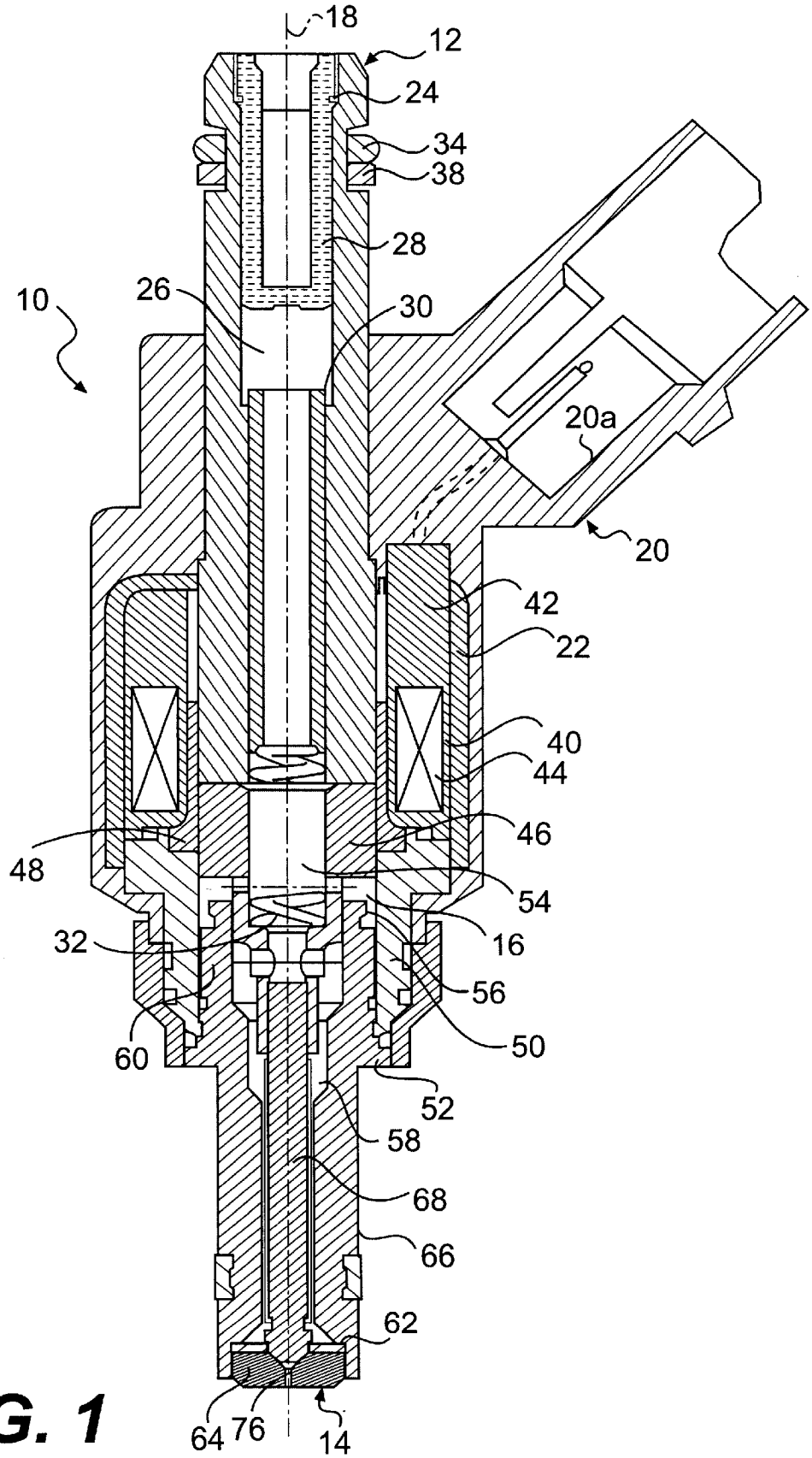
FIG. 1 is a cross-sectional view of a fuel injector of the present invention taken along its longitudinal axis.
Figure 2:
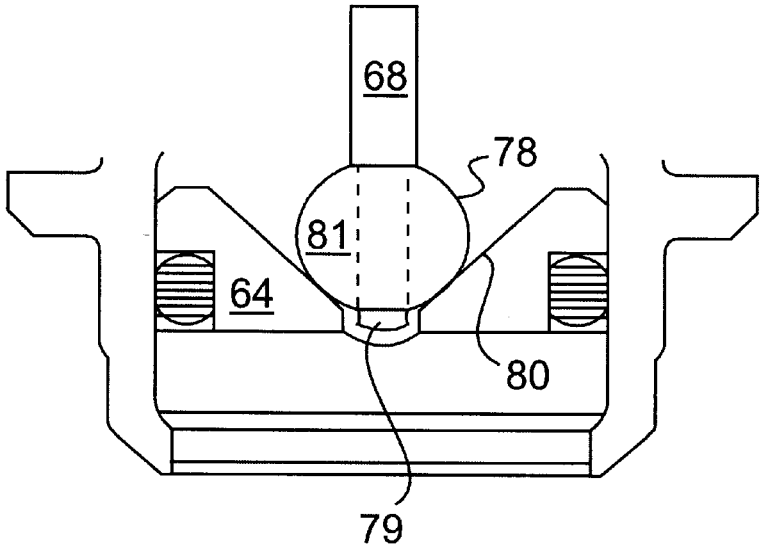
FIG. 2 is a plan view of the ball seat of the present invention of FIG. 1.

FIG. 1 illustrates a fuel injector assembly 10, such as a fuel injector assembly 10. The fuel injector assembly 10 has a housing, which includes a fuel inlet 12, a fuel outlet 14, and a fuel passageway 16 extending from the fuel inlet 12 to the fuel outlet 14 along a longitudinal axis 18. The housing includes an overmolded plastic member 20 cincturing a metallic support member 22.

A fuel inlet member 24 with an inlet passage 26 is disposed within the overmolded plastic member 20. The inlet passage 26 serves as part of the fuel passageway 16 of the fuel injector assembly 10. A fuel filter 28 and an adjustable tube 30 is provided in the inlet passage 26. The adjustable tube 30 is positionable along the longitudinal axis 18 before being secured in place, thereby varying the length of an armature bias spring 32. In combination with other factors, the length of the spring 32, and hence the bias force against the armature, control the quantity of fuel flow through the fuel injector assembly 10. The overmolded plastic member 20 also supports a socket 20*a* that receives a plug (not shown) to operatively connect the fuel injector assembly 10 to an external source of electrical potential, such as an electronic control unit ECU (not shown). An elastomeric O-ring 34 is provided in a groove on an exterior extension of the inlet member 24. The O-ring 34 is biased by a flat spring 38 to sealingly secure the inlet member 24 to a fuel supply member (not shown), such as a fuel rail.

The metallic support member 22 encloses a coil assembly 40. The coil assembly 40 includes a bobbin 42 that retains a coil 44. The ends of the coil assembly 40 are electrically connected to the socket 20*a* of the overmolded plastic member 20. An armature 46 is supported for relative movement along the axis 18 with respect to the inlet member 24. The armature 46 is supported by a spacer 48, a body shell 50, and a body 52. The armature 46 has an armature passage 54 in fluid communication with the inlet passage 26.

The spacer 48 engages the body shell 50, which engages the body 52. An armature guide eyelet 56 is located on an inlet portion 60 of the body 52. An axially extending body passage 58 connects the inlet portion 60 of the body 52 with an outlet portion 62 of the body 52. The armature passage 54 of the armature 46 is in fluid communication with the body passage 58 of the body 52. A seat 64, which is preferably a metallic material, is mounted at the outlet portion 62 of the body 52.

The body 52 includes a neck portion 66 that extends between the inlet portion 60 and the outlet portion 62. The neck portion 66 can be an annulus that surrounds a needle 68. The needle 68 is operatively connected to the armature 46, and can be a substantially cylindrical needle 68. The cylindrical needle 68 is centrally located within and spaced from the neck portion so as to define a part of the body passage 58. The cylindrical needle 68 is axially aligned with the longitudinal axis 18 of the fuel injector assembly 10. A ball 81 is operatively connected to the cylindrical needle 68 proximate the fuel injector outlet 14 at needle support portion 90. A needle control portion (tip) 79 protrudes out of a through passage 81' (hidden) in the ball 81.

Operative performance of the fuel injector assembly 10 is achieved by magnetically coupling the armature 46 to the end of the inlet member 26 that is closest to the inlet portion 60 of the body 52. Thus, the lower portion of the inlet member 26 that is proximate to the armature 46 serves as part of the magnetic circuit formed with the armature 46 and coil assembly 40. The armature 46 is guided by the armature guide eyelet 56 and is responsive to an electromagnetic force generated by the coil assembly 40 for axially reciprocating the armature 46 along the longitudinal axis 18 of the fuel injector assembly 10. The electromagnetic force is generated by current flow from the ECU (not shown) through the coil assembly 40. Movement of the armature 46 also moves the operatively attached needle 68. As shown in FIGS. 1–3B, ball 81 is operatively connected to needle 68 and engages the seat 64. Ball 81 opens and closes the seat passage 76 of the seat 64 of the present invention to permit or inhibit, respectively, fuel from exiting the outlet of the fuel injector assembly 10. In order to open seat passage 76, the seal between the ball 81 and the seat 64 is broken by upward movement of the needle 68. The needle 68 moves upwards when the magnetic force is substantially higher then it needs to be to lift the armature needle assembly against the force of spring 32. In order to close the seat passage 76 of the seat 64, the magnetic coil assembly 40 is de-energized. This allows ball 81 to re-engage surface 80 of seat 64 and close passage 76. The surface 78 of ball 81 is preferably a spherical surface. During operation, fuel flows in fluid communication from the fuel inlet source (not shown) through the fuel inlet passage 26 of the inlet member 24, the armature passage 54 of the armature 46, the body passage 58 of the body 52, and the seat passage 76 of the seat 64 and is injected from the outlet 14 of the fuel injector assembly 10.

Figure 3A:
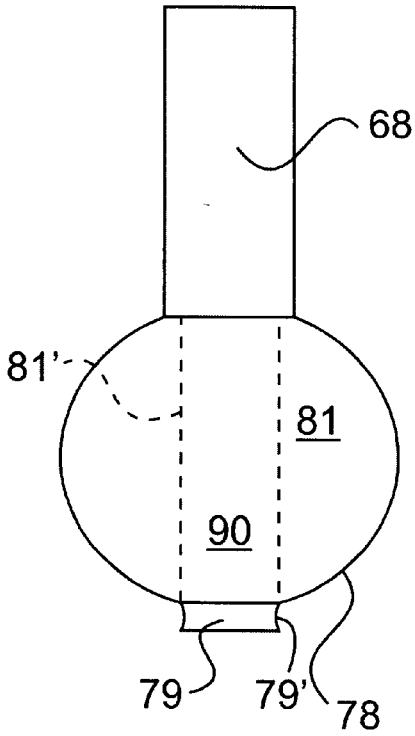
FIG. 3A is a plan view of a needle tip with a concave tip geometry.
Figure 3B:
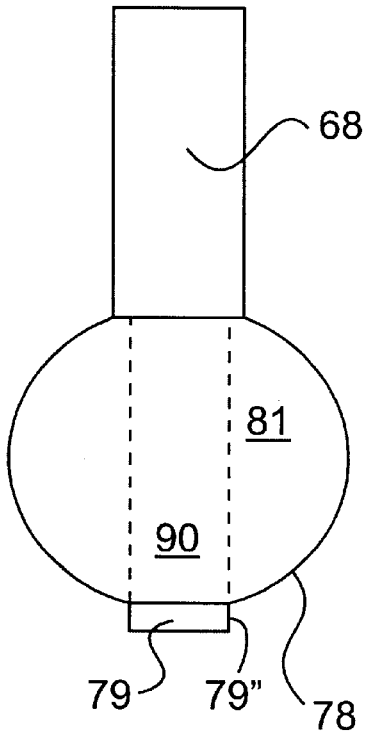
FIG. 3B is a plan view of a needle tip with a linear tip geometry.

The ball 81 and the needle flow control portion 79 will now be described in detail. As shown in FIGS. 3A and 3B, the ball 81 is attached to the needle 68 by means of welding, press fitting, or by any other means well known in the art. Because mating between the surface 78 of ball 81 and the surface 80 of seat 64 is the only means of preventing fuel from ejecting through the passage 76 of seat 64, a highly accurate surface finish for the ball surface 78 is required. The needle flow control portion 79 however only affects the spray pattern and the particle sizes emitted from the passage 76 of seat 64. Thus a highly accurate surface finish for needle flow control portion 79 is not required. The present invention therefore provides a ball 81 which has a highly accurate machined surface 78 that mates with the highly accurate surface 80 of seat 64. Before or after welding or press fitting of ball 81 onto needle 68, the exposed needle flow control portion 79 can be machined as necessary. FIG. 3A shows a machined needle flow control portion 79 that has concave sides 79'. Similarly, FIG. 3B shows a machined needle flow control portion 79 that has linear sides 79". It can be appreciated that as the fuel passes through body passage 58 towards seat passage 76, the concave sides 79' of needle flow control portion 79 will disperse the fuel in a wider pattern than that for the linear sides 79" of needle flow control portion 79. Similarly, one of ordinary skill in the art could envision a variety of other flow control portion configurations (i.e. convex, notched, sloped and varying cross-sections relative to the needle longitudinal axis) that would yet further improve or alter spray atomization and the spray pattern, and reduce the sac volume in the area between the ball and seat sealing surfaces and the seat passage 76, for fuel injectors and other such devices.

While the present invention has been disclosed with reference to certain preferred embodiments, numerous modifications, alterations, and changes to the described embodiments are possible without departing from the sphere and scope of the present invention, as defined in the appended claims. Accordingly, it is intended that the present invention not be limited to the described embodiments, but that it have the fall scope defined by the language of the following claims, and equivalents thereof.

What is claimed is:

1. A fuel injector having a fuel inlet, a fuel outlet, and a fuel passageway extending from the fuel inlet to the fuel outlet along a longitudinal axis, the fuel injector comprising:

a body;

a cylindrical needle slidingly disposed within the body, the needle having a support portion and a flow control portion;

a seat disposed at the fuel outlet; and control portion protrudes from tha ball toward the seat.

2. The fuel injector of claim 1, wherein the flow control portion protrudes out of a through passage in the ball and is configured to control the fuel spray pattern.

3. The fuel injector of claim 1, wherein the flow control portion has a similar cross-section as the needle transverse to a needle longitudinal axis.

4. The fuel injector of claim 1, wherein the flow control portion has a different cross-section than the needle transverse to a needle longitudinal axis.

5. The fuel injector of claim 1, wherein the flow control portion is machined separately from the ball.

6. The fuel injector of claim 1, wherein the flow control portion has a concave cross-section in a needle longitudinal axis direction.

7. The fuel injector of claim 1, wherein the flow control portion has a convex cross-section in a needle longitudinal axis direction.

8. The fuel injector of claim 1, wherein the flow control portion has a sloped cross-section in a needle longitudinal axis direction.

9. The fuel injector of claim 1, wherein the flow control portion has a notched cross-section in a needle longitudinal axis direction.

10. A method of controlling a fuel spray pattern in a fuel injector, the fuel injector having a body, a cylindrical needle slidingly disposed within the body, the needle having a support portion and a flow control portion, and a seat disposed at the fuel outlet, and method comprising the steps of:

providing a ball operatively connected to the support portion of the needle such that the flow control portion of the needle protrudes from the ball toward the seat; and providing fuel to the fuel injector.

11. The method according to claim 10, wherein the flow control portion protrudes out of a through passage in the ball and is configured to control the fuel spray pattern.

12. The method according to claim 10, wherein the flow control portion has a similar cross-section as the needle transverse to a needle longitudinal axis.

13. The method according to claim 10, wherein the flow control portion has a different cross-section than the needle transverse to a needle longitudinal axis.

14. The method according to claim 10, wherein the flow control portion is machined separately from the ball.

15. The method according to claim 10, wherein the flow control portion has a concave cross-section in a needle longitudinal axis direction.

16. The method according to claim 10, wherein the flow control portion has a convex cross-section in a needle longitudinal axis direction.

17. The method according to claim 10, wherein the flow control portion has a sloped cross-section in a needle longitudinal axis direction.

18. The method according to claim 10, wherein the flow control portion has a notched cross-section in a needle longitudinal axis direction.

a ball operatively connected to the support portion of the needle such that the flow control portion of the needle protrudes from the ball toward the seat.

* * * * *